US007452105B2

(12) United States Patent
Hough

(10) Patent No.: US 7,452,105 B2
(45) Date of Patent: Nov. 18, 2008

(54) OPTICAL SYSTEM FOR A WASH LIGHT

(75) Inventor: Thomas A. Hough, Tucson, AZ (US)

(73) Assignee: Whiterock Design, LLC, Tucson, AZ (US)

( * ) Notice: Subject to any disclaimer, the term of this patent is extended or adjusted under 35 U.S.C. 154(b) by 251 days.

(21) Appl. No.: 11/347,457

(22) Filed: Feb. 3, 2006

(65) Prior Publication Data

US 2006/0176696 A1 Aug. 10, 2006

Related U.S. Application Data

(60) Provisional application No. 60/649,983, filed on Feb. 4, 2005.

(51) Int. Cl.
*F21S 8/00* (2006.01)

(52) U.S. Cl. ..... 362/268; 362/293

(58) Field of Classification Search ..... 362/268, 362/364, 365, 293, 230, 277, 282, 319
See application file for complete search history.

(56) References Cited

U.S. PATENT DOCUMENTS

| | | | | |
|---|---|---|---|---|
| 4,037,097 | A | | 7/1977 | Stillman et al. |
| 4,958,265 | A | | 9/1990 | Solomon |
| 5,073,847 | A | | 12/1991 | Bornhorst |
| 5,126,886 | A | | 6/1992 | Richardson et al. |
| 5,186,536 | A | | 2/1993 | Bornhorst et al. |
| 5,446,637 | A | | 8/1995 | Cunningham et al. |
| 5,515,254 | A | | 5/1996 | Smith et al. |
| 5,544,029 | A | | 8/1996 | Cunningham |
| 5,622,426 | A | | 4/1997 | Romano et al. |
| 5,844,638 | A | * | 12/1998 | Ooi et al. ..... 349/10 |
| 5,882,107 | A | | 3/1999 | Bornhorst et al. |
| 5,904,417 | A | | 5/1999 | Hewett |
| RE36,316 | E | | 9/1999 | Cunningham |
| 5,969,868 | A | * | 10/1999 | Bornhorst et al. ..... 359/589 |
| 6,048,080 | A | | 4/2000 | Belliveau |
| 6,113,252 | A | * | 9/2000 | Arlitt et al. ..... 362/365 |
| 6,241,366 | B1 | | 6/2001 | Roman et al. |
| 6,572,241 | B1 | | 6/2003 | Chan et al. |
| 6,796,682 | B2 | | 9/2004 | Hough et al. |
| 6,796,683 | B2 | | 9/2004 | Wood et al. |
| 2003/0206414 | A1 | | 11/2003 | Wood et al. |
| 2005/0018423 | A1 | | 1/2005 | Warnecke et al. |

FOREIGN PATENT DOCUMENTS

| | | |
|---|---|---|
| EP | 1 167 868 | 1/2002 |

* cited by examiner

*Primary Examiner*—Thomas M Sember

(57) ABSTRACT

A wash light optical system for use with a light beam generator includes a converging optical element that reduces the size of a light beam from the light beam generator, a color filtration mechanism that is capable of filtering the reduced light beam to a selected one of two or more colors, a spreading optical element that increases the size of the filtered light beam, and a beam shaping optical element. The optical system may also include a dimming mechanism that is capable of reducing the intensity of the light beam to a selected one of two or more intensities. The optical system may be enclosed in a housing that includes a coupling mechanism capable of detachably mounting the housing to the light beam generator.

17 Claims, 4 Drawing Sheets

OPTICAL SYSTEM FOR A WASH LIGHT

CROSS-REFERENCE TO RELATED APPLICATIONS

This application claims priority under 35 U.S.C. § 119(e) to U.S. Provisional Application No. 60/649,983, filed on Feb. 4, 2005, which is hereby incorporated by reference.

TECHNICAL FIELD OF THE INVENTION

The present invention relates to optical systems and, more particularly, to an optical system for a wash light.

BACKGROUND OF THE INVENTION

The Ellipsoidal Reflector Spotlight (ERS) and the Parabolic Wash light (PAR) are two of the most popular lighting fixtures used in theatre, television, and architectural lighting. An ERS employs a reflector generated from an ellipsoidal or near-ellipsoidal curve rotated about the longitudinal axis of the optical system to define a reflecting surface, typically referred to as an ellipsoidal reflector. An ERS also produces a beam with a sharp edge, which, if projected on a flat surface, results in a 'spot' of light.

In a PAR optical system, a parabolic or near-parabolic curve is used to define a reflecting surface, typically referred to as a parabolic reflector. A beam exiting a parabolic reflector is substantially parallel to the optical axis of the PAR system. That is, the light beam is made up of light rays that are substantially parallel to each other and to the optical axis. Several such light beams may be used to 'wash' a target in light, where the beams overlap without the edges of individual beams being distinguishable.

FIG. 1 presents a schematic cross-section view of a prior art ERS optical system 100. A lamp 102 is mounted in an ellipsoidal reflector 104. The lamp 102 and the reflector 104 each have a longitudinal axis, which are coincident and define an optical axis 120 for the ERS optical system 100. The reflector 104 has a rim 105 forming an aperture from which emerges a light beam 106. When the lamp 102 is positioned adjacent to one of the two foci defining the ellipsoidal or near-ellipsoidal curve used to generate the reflector 104, the light beam 106 converges to a narrow diameter at the second focus of the reflector. In the ERS optical system 100, a projection gate 108 is located adjacent to this second focus. The projection gate 108 may simply be a circular aperture, or it may contain a light pattern generator 110.

Light rays of the light beam 106 cross over the optical axis 120 as they pass through the projection gate 108, resulting in diverging light beam 112. The light beam 112 is converged by a projection lens 114 to form light beam 116. The projection lens 114 projects an image 118 of the light pattern generator 110 located in the projection gate 108. If no light pattern generator is present, the projection lens instead projects an image of the projection gate 108 itself. The projected image of the projection gate 108 or the light pattern generator 110 comes into focus at a distance from the projection lens 114 determined by several optical properties of the optical system 100. By repositioning the projection lens 114 along the optical axis, the resulting image can be made to be in focus at various distances from the projection lens 114, resulting in a beam with a sharp, or hard, edge.

A PAR optical system, in contrast, may consist solely of a parabolic reflector and lamp, although a lens may be placed after the reflector to further smooth or shape the beam. A PAR optical system does not project an image and is therefore referred to as a non-imaging optical system. The edges of a light beam produced by a PAR optical system are not sharp and may fall off quite gradually, resulting in a soft-edged pool of light.

An ERS optical system may alternatively be designed to produce a soft-edged wash beam. If a non-imaging lens, such as a stippled Fresnel lens, is employed in place of the projection lens 114, the light beam produced is substantially parallel to the optical axis 120 of the optical system and the edges of the light beam are softer. Typically, the user of a wash light fixture desires that a large diameter light beam exit the lighting fixture, requiring that such a non-imaging lens be placed at a greater distance from the projection gate 108 than the projection lens 114, where the light beam 112 has diverged to a suitably large diameter. Thus, an ellipsoidal wash light fixture of this design is typically longer than an ERS spot light fixture employing the same ellipsoidal reflector. An ellipsoidal reflector whose second focus is closer to the rim of the reflector may be used to reduce the length of an ellipsoidal wash light fixture of this design.

In another alternative, in order to soften the edges of the beam of an ERS optical system, diffusion, or scattering, of the light beam may be introduced at some location in the optical system. This diffusion may be placed in the beam manually, as part of preparing the light for use. Alternatively, the diffusion may be inserted and removed from the beam by a motorized mechanism, controlled by an operator from outside the light fixture. However, such diffused beams are often not considered by users as a suitable replacement for a beam from a parabolic optical system or an ellipsoidal optical system with a non-imaging lens.

Wash light fixtures may also be designed around reflectors of types other than ellipsoidal and parabolic reflectors. For example, a symmetric reflector may be generated by rotating about the longitudinal axis of the optical system a segment of a curve defined by a mathematical function other than an ellipse or parabola, or a segment of an arbitrary curve. Other reflectors may have a non-circular cross-section designed to smooth the irradiance distribution of light beams generated from lamps having an asymmetric intensity distribution.

In the design of any wash light fixture, at least two challenges are encountered. First, a small overall size for the fixture is desired in order to allow more fixtures to be placed in an available space, and, in the case of remotely controlled motorized fixtures, to reduce the size and power requirements of the motors and mechanisms. Second, while a large beam size from the fixture is generally desirable, the materials used to filter the color of the light beam in the fixture may be expensive, leading to a desire to minimize the amount of filter material used in each fixture.

A theatrical, television, or architectural lighting system typically includes both spot and wash lights. As a result, a company manufacturing or renting lighting systems typically maintains an inventory of both types of light fixtures.

FIG. 2 depicts a schematic cross-section view of a prior art ellipsoidal reflector spotlight 200. A lamp 202 and ellipsoidal reflector 204 project a light beam through a projection gate 208. A projection lens 214 forms an image of the projection gate 208 at a distance from a front aperture 236 of the ERS 200.

The lamp 202 and ellipsoidal reflector 204 are enclosed in a reflector housing 230 to form a light beam generator. Attached to the reflector housing 230 is a lens barrel 232, which encloses the projection lens 214 and the projection gate 208. A coupling mechanism 234 may allow the lens barrel 232 to be removed from the reflector housing 230 and to rotate about an optical axis 220 of the ERS 200. This rotation permits a light pattern generator installed in the projection gate 208 to be aligned at a desired angle.

SUMMARY OF THE INVENTION

The present invention provides a wash light optical system for use with an ellipsoidal reflector. The optical system may be enclosed in a housing that may be detachably mounted to a lamp housing of an existing ellipsoidal reflector spotlight. The optical system may be employed in an ellipsoidal wash light fixture using the same ellipsoidal reflector as an ellipsoidal reflector spot lighting fixture. The optical system may be designed to have a short overall length and to use a reduced amount of color filter material.

More specifically, aspects of the invention may be found in an optical system for use with a light beam generator. The optical system includes a converging optical element that reduces the size of a light beam from the light beam generator. The optical system also includes a color filtering mechanism that is capable of filtering the light beam to a selected one of two or more colors. A spreading optical device in the optical system increases the size of the light beam, which then passes through a beam shaping optical device. The optical system may also include a dimming mechanism that is capable of reducing the intensity of the light beam to a selected one of two or more intensities. The optical system may be enclosed in a housing that includes a coupling mechanism capable of detachably mounting the housing to the light beam generator.

Other aspects of the invention may be found in a light fixture that includes a light beam generator. The light fixture also includes a converging optical element that reduces the size of a light beam from the light beam generator. The light fixture further includes a color filtering mechanism that is capable of filtering the light beam to a selected one of two or more colors. A spreading optical device in the light fixture increases the size of the light beam, which then passes through a beam shaping optical device. The light fixture may also include a dimming mechanism that is capable of reducing the intensity of the light beam to a selected one of two or more intensities.

Further aspects of the invention may be found in a method of generating a light beam having a desired color and shape. The method includes generating a light beam having a size and converging the light beam to a smaller size. The method also includes filtering the light beam to a selected one of two or more colors and spreading the light beam to a larger size. The method further includes shaping the light beam to a desired shape. The method may include dimming the light beam to a selected one of a plurality of intensities.

Aspects of the invention may also be found in a method of producing a light fixture capable of generating a light beam having a desired color and shape. The method includes providing a housing that includes a coupling mechanism and encloses an optical system. The method also includes detachably mounting the housing to a light beam generator using the coupling mechanism. The optical system includes a converging optical element that reduces the size of a light beam from the light beam generator. The optical system also includes a color filtering mechanism that is capable of filtering the light beam to a selected one of two or more colors. A spreading optical device in the optical system increases the size of the light beam, which then passes through a beam shaping optical device.

As such, an optical system, light fixture and method for a wash light are described. Other aspects, advantages and novel features of the present invention will become apparent from the detailed description of the invention and claims, when considered in conjunction with the accompanying drawings.

BRIEF DESCRIPTION OF THE DRAWINGS

For a more complete understanding of the present invention and its advantages, reference is now made to the following description taken in conjunction with the accompanying drawing, wherein like reference numerals represent like parts, in which.

DETAILED DESCRIPTION OF EXAMPLE EMBODIMENTS

Figure 2:
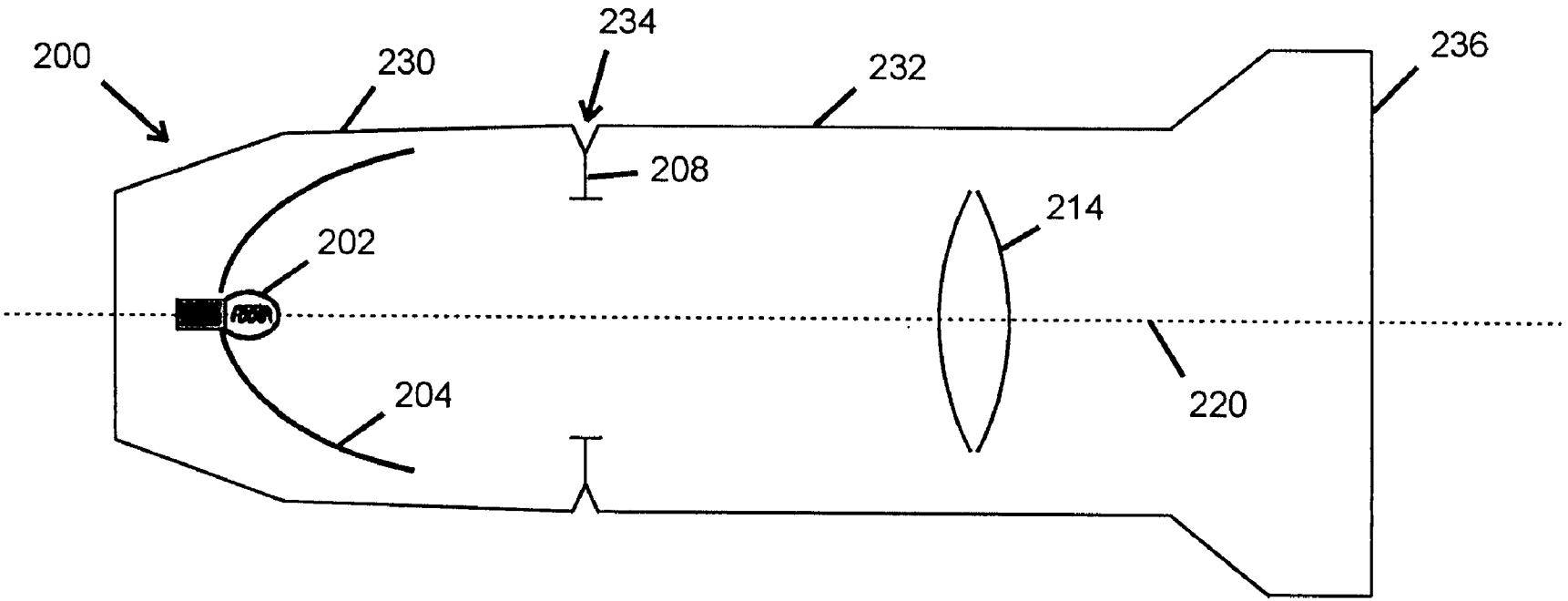
Fig. 2 Prior Art
FIG. 2 depicts a schematic cross-section view of a prior art ellipsoidal reflector spotlight.
Figure 3:
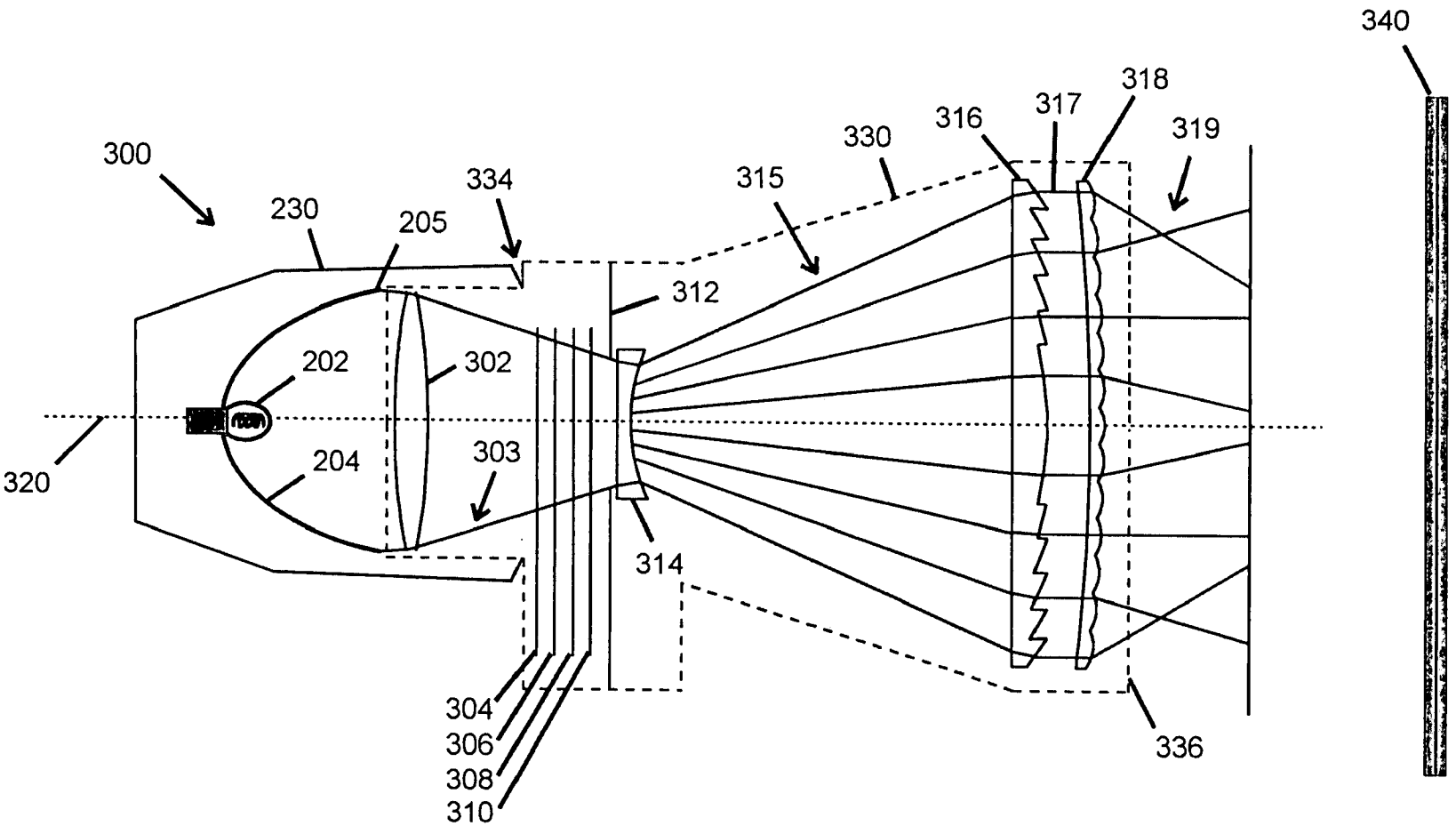
FIG. 3 presents a schematic cross-section view of an optical system according to the present invention.

FIG. 3 presents a schematic cross-section view of an optical system according to the present invention that mounts on the reflector housing 230 of the ERS 200 shown in FIG. 2 to form an ellipsoidal reflector wash light fixture 300. An optical system housing 330 is detachably mounted to the reflector housing 230 by a coupling mechanism 334.

An optical system embodying the present invention may include a converging optical element 302 that accepts a light beam emerging from the rim 205 of the ellipsoidal reflector 204. The converging optical element 302 produces a converging light beam 303, which converges toward a field stop plate 312. The field stop plate 312 blocks any light rays outside the desired contours of the light beam 303.

In the embodiment of the present invention shown in FIG. 3, the converging optical element 302 is a lens having a positive focal length, a so-called 'positive' lens. It will be understood that alternative optical elements may be employed to converge the light beam without departing from the scope of the invention. For example, a series of concentric reflective rings could be used to progressively redirect the light beam into a narrower beam.

The converging light beam 303 may pass through a dimming mechanism 304 and color filtering mechanisms 306, 308 and 310, located adjacent to the field stop plate 312. While the field stop plate 312 is shown in FIG. 3 on the opposite side of the dimming and color mechanisms 304-310 from the converging optical element 302, it will be understood that the mechanisms 304-310 may be placed before or after the field stop plate 312, and the field stop plate 312 and the mechanisms 304-310 may be placed in any desired order adjacent to the convergence point of the light beam 303 without departing from the scope of the invention.

The dimming mechanism 304 may be any of several known mechanisms, such as an iris, a neutral density wheel or a neutral density sliding plate. In some embodiments, the dimming mechanism 304 is a glass wheel having a reflective coating. The coating may be ablated or etched in a pattern to produce a gradual transition from fully transmissive (clear) to fully reflective (opaque).

In some embodiments, the dimming mechanism 304 is a motorized mechanism having a controller. The controller may be capable of receiving a control signal and responding to the control signal by positioning the dimming mechanism 304 to reduce the intensity of the light beam to a selected intensity indicated by the value of the control signal.

In another embodiment of the present invention the lamp 202 may be electrically dimmable, such as an incandescent lamp. It will be understood that the dimming mechanism 304 may be omitted from such a light fixture without departing from the scope of the present invention.

Similarly, the color filtering mechanisms 306-310 may be any of several known mechanisms, such as variable saturation color wheels or sliding plates, or wheels or semaphore mechanisms carrying multiple discrete color filters. In some embodiments, the color filtering mechanisms 306-310 are glass wheels having cyan, yellow and magenta dichroic filter coatings, respectively. The coatings may be ablated or etched in a pattern to produce a gradual transition from no coating (no filtration) to fully coated (fully filtered).

In some embodiments, the color filtering mechanisms 306-310 are motorized mechanisms having a controller. The controller may be capable of receiving a control signal and responding to the control signal by positioning the color filtering mechanisms 306-310 to filter the light beam to a selected color indicated by the value of the control signal.

Figure 1:
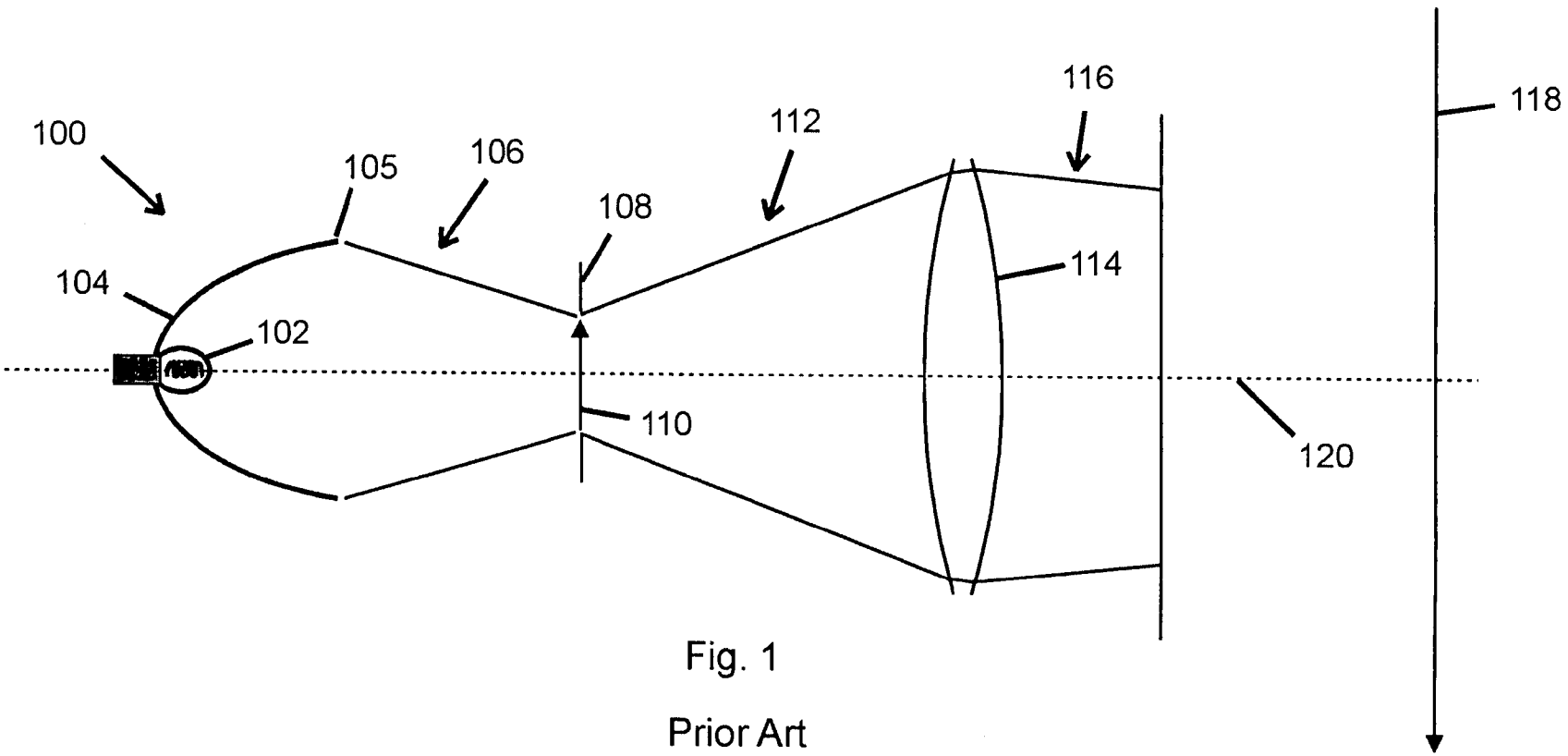
Fig. 1 Prior Art
FIG. 1 presents a schematic cross-section view of a prior art ellipsoidal reflector spotlight optical system.

As shown in FIG. 1, a light beam produced by a lamp adjacent to a first focus of an ellipsoidal reflector converges towards a second focus of the reflector. However, the converging optical element 302 of FIG. 3 causes the beam to converge to a smaller diameter in a lesser distance, permitting an optical system according to the present invention to have a smaller color filtering and/or dimming mechanism and a shorter overall length than an optical system without a corresponding converging optical element.

After the light beam 303 passes through the dimming mechanism 304, the color filtering mechanisms 306-310, and the field stop plate 312, a spreading optical element 314 (a negative lens in this embodiment of the invention) may spread the light beam to form a diverging beam 315. A collimating optical element 316 may then collimate the light beam to shape it into a substantially columnar light beam 317. The collimating optical element 316 may be a Fresnel lens (as shown in FIG. 3), a plano-convex lens, a biconvex lens, or any other optical element having a positive focal length. An additional beam shaping optical element 318 may shape the beam further.

Because the negative lens 314 and the collimating optical element 316 do not form an image of the field stop plate 312 or the dimming and color mechanisms 304-310 on a distant projection surface 340, the light beam 317 is a soft-edged beam with even color characteristics, producing a wash effect when it strikes the distant flat surface 340. If an even softer edge is desired, a diffusion texture may be applied to one surface of a lens used as the collimating optical element 316, or a diffusion material may be used as the beam shaping optical element 318, resulting in a scrambling of the light rays of light beam 317, as indicated at 319.

In other embodiments, the beam shaping optical element 318 may be a lenticular array, which shapes the beam by spreading it by differing amounts in different planes passing through an optical axis 320 of the optical system of the light fixture 300. A lenticular array is an array of lenticules (or 'lenslets') having a cylindrical, spherical or other surface with a symmetry along one or more axes. For example, a lenticular array having hemi-cylindrical lenticules with parallel longitudinal axes may spread the beam very little in a plane passing through the optical axis of the optical system and parallel to the longitudinal axes of the lenticules. However, in a plane passing through the optical axis and perpendicular to the lenticules' longitudinal axis, the light beam may be spread by an amount determined by the curvature of the surface of the lenticules.

As described above, the beam shaping optical element 318 is an optional element in an optical system embodying the present invention. As such, the housing 330 may be designed such that the optical element 318 may be inserted or removed from the optical system. Furthermore, because some optical elements 318 may produce a non-circular shape in the light beam 319, the housing 330 may also be designed to enable the beam shaping optical element 318 to rotate about the optical axis 320 to a desired angular orientation.

Figure 4:
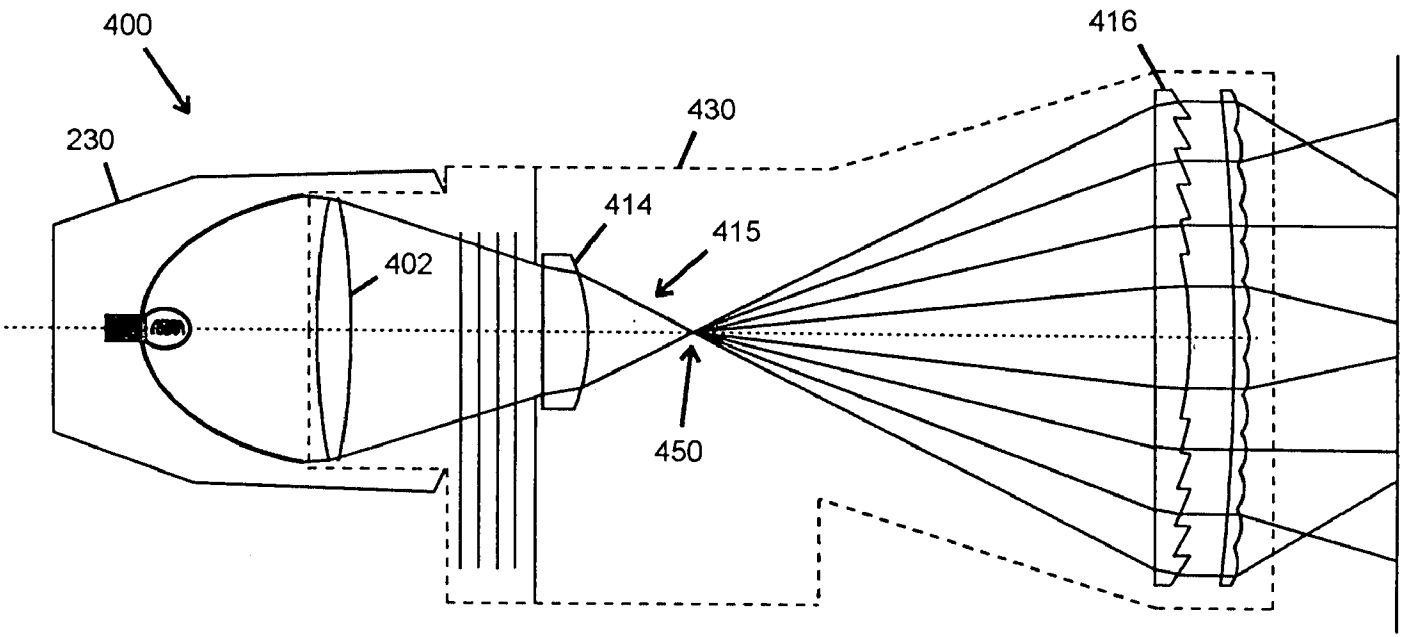
FIG. 4 shows a schematic cross-section view of another optical system according to the present invention.

FIG. 4 shows a schematic cross-section view of another optical system according to the present invention. In the optical system of ellipsoidal reflector wash light fixture 400, spreading optical element 414 is a positive lens. Light beam 415 emerging from the optical element 414 first converges to a focus 450 and then diverges to illuminate collimating optical element 416. Were the focal length of the collimating optical element 416 the same as that of the collimating optical element 316 in FIG. 3, the length of light fixture 400 would be longer than that of light fixture 300. However, by designing the collimating optical element 416 to have a shorter focal length than optical element 316, the length of light fixture 400 may be made the same as the length of light fixture 300.

Similarly, in an alternative embodiment of the present invention (not shown) employing a converging optical element 402 having a shorter focal length, the optical element may be located at the aperture of the reflector housing 230. In this way, housing 430 could be designed not to extend into the reflector housing 230, as the housings 330 and 430 do in the embodiments of the invention shown in FIGS. 3 and 4, respectively.

FIGS. 3 and 4 depict optical systems according to the present invention that are enclosed in a housing that may be mounted to a lamp housing of an existing ellipsoidal reflector spotlight. In the alternative, an ellipsoidal reflector wash light according to the present invention could be enclosed in a unitary housing. In such an embodiment, all elements of the optical system, from the lamp and reflector to the collimating optical element and any additional beam shaping element, may be enclosed within a single housing. Such an embodiment might be useful, for example, to a light fixture manufacturer seeking to use the same ellipsoidal reflector in both an ellipsoidal spotlight and an ellipsoidal wash light.

While the present invention has been described in detail with respect to certain embodiments thereof, those skilled in the art should understand that various changes, substitutions, modifications, alterations, and adaptations in the present invention may be made without departing from the concept and scope of the invention in its broadest form.

What is claimed is:

1. An optical system for use with a light beam generator, the optical system comprising:

a converging optical device through which a light beam from the light beam generator passes, wherein the converging optical device reduces a size of the light beam;

a color filtering mechanism through which the light beam passes after passing through the converging optical device;

a spreading optical device through which the light beam passes after passing through the color filtering mechanism, wherein the spreading optical device increases the size of the light beam; and a beam shaping optical device through which the light beam passes after passing through the spreading optical device, wherein the color filtering mechanism is capable of filtering the light beam to a selected one of a plurality of colors, and the spreading optical device comprises one of a positive lens and a negative lens.

2. The optical system of claim 1, further comprising a dimming mechanism through which the light beam passes, wherein the dimming mechanism is capable of reducing an intensity of the light beam to a selected one of a plurality of intensities.

3. The optical system of claim 1, wherein the beam shaping optical device comprises a Fresnel lens.

4. The optical system of claim 3, wherein the beam shaping optical device further comprises a beam shaping optical element selected from a group consisting of a diffusion device, a lenticular array, and a faceted array.

5. The optical system of claim 1, further comprising a housing enclosing the converging optical device, color filtering mechanism, spreading optical device, and beam shaping device, wherein the housing comprises a coupling mechanism capable of detachably mounting the housing to the light beam generator.

6. The optical system of claim 5, wherein the light beam generator comprises a reflector housing of an ellipsoidal reflector spotlight.

7. The optical system of claim 5, wherein:

the housing extends into the light beam generator;

the light beam generator comprises a reflector having a rim; and the converging optical device is located adjacent to the rim of the reflector.

8. The optical system of claim 1, further comprising a housing enclosing the converging optical device, the color filtering mechanism, the spreading optical device, and the beam shaping optical device, wherein:

the housing comprises a coupling mechanism capable of detachably mounting the housing to the light beam generator;

the optical system has an optical axis; and the beam shaping optical element is removably mounted to the housing and capable of rotating about the optical axis.

9. A light fixture, comprising:

a light beam generator;

a converging optical device through which a light beam from the light beam generator passes, wherein the converging optical device reduces a size of the light beam;

a color filtering mechanism through which the light beam passes after passing through the converging optical device;

a spreading optical device through which the light beam passes after passing through the color filtering mechanism, wherein the spreading optical device increases the size of the light beam; and a beam shaping optical device through which the light beam passes after passing through the spreading optical device, wherein the color filtering mechanism is capable of filtering the light beam to a selected one of a plurality of colors, and the spreading optical device comprises one of a positive lens and a negative lens.

10. The light fixture of claim 9, further comprising a dimming mechanism through which the light beam passes after passing through the converging optical device and before passing through the spreading optical device, wherein the dimming mechanism is capable of reducing an intensity of the light beam to a selected one of a plurality of intensities.

11. The light fixture of claim 9, wherein the beam shaping optical device comprises a Fresnel lens.

12. The light fixture of claim 11, wherein the beam shaping optical device further comprises a beam shaping optical element selected from a group consisting of a diffusion device, a lenticular array, and a faceted array.

13. The light fixture of claim 12, wherein:

the light fixture has a housing and an optical axis; and the beam shaping optical element is removably mounted to the housing such that the beam shaping optical element is capable of rotation about the optical axis.

14. A method of generating a light beam having a desired color and shape, comprising:

generating a light beam having a size;

converging the light beam to a smaller size;

filtering the converged light beam to a selected one of a plurality of colors;

spreading the filtered light beam to a larger size with one of a positive and a negative lens; and shaping the spread light beam to a desired shape.

15. The method of claim 14, further comprising dimming the light beam to a selected one of a plurality of intensities.

16. The method of claim 14, wherein the step of shaping the spread light beam comprises collimating the spread light beam with a Fresnel lens.

17. The method of claim 16, wherein the step of shaping the spread light beam further comprises shaping the spread light beam with a beam shaping optical element selected from a group consisting of a diffusion device, a lenticular array, and a faceted array.

* * * * *